US005784479A

United States Patent [19]

Chen

[11] Patent Number: 5,784,479

[45] Date of Patent: Jul. 21, 1998

[54] LOUDSPEAKER FRAME

[76] Inventor: Yu-ying Chen, 2nd Fl., No. 12 Lane 31, Shuiyuan Rd., Taipei, Taiwan

[21] Appl. No.: 663,874

[22] Filed: Jun. 19, 1996

[51] Int. Cl.[6] ..... H04R 25/00

[52] U.S. Cl. ..... 381/205; 381/87

[58] Field of Search ..... 381/199, 194, 381/201, 192, 204, 87; 264/2.5, 35

[56] References Cited

U.S. PATENT DOCUMENTS 4,625,328 11/1986 Freadman ..... 381/87

*Primary Examiner*—Sinh Tran

*Attorney, Agent, or Firm*—Sixbey, Friedman, Leedom & Ferguson, PC; Stuart J. Friedman

[57] ABSTRACT

A loudspeaker frame has a body, a flange, a plurality of ribs connected therebetween and a metal disc securely retained within the body. The body has a central hole which is concentric to the flange. In an inner periphery of the central hole, a peripheral shoulder is formed for providing support and retaining effect to the metal disc when the frame is injection molded.

1 Claim, 4 Drawing Sheets

LOUDSPEAKER FRAME

FIELD OF THE INVENTION

The present invention generally relates to a loudspeaker frame, and more particularly to a frame used especially in a stereo speaker.

BACKGROUND OF THE INVENTION

This invention has a particular application to a loudspeaker frame, which is made of plastic, and has a metal disc embedded therein for combining all the advantages of plastic and metal together, and cutting down manufacturing expenses.

A frame 10 of a prior loudspeaker, as shown in FIG. 3, which is widely used in many areas is usually made of metal. The frame 10 is configured to have a flange 11, and a body 12 with a plurality of ribs 111 connected therebetween. Both of the body 12 and the flange 11 are provided with concentric central holes 121. A plurality of through holes 122 are defined in a bottom face of the body 12 for securing a disc 20 thereto with fastening screws 30 inserted into screwholes 21 defined in the disc 20. A perspective view and a sectional view of the assembled frame 10 and disc 20 are respectively shown in FIGS. 4 and 5.

It is common knowledge that the disc 20, usually made of metal, will corrode easily. The frame 10, if an injection molded frame, is not able to be assembled with the disc 20 by riveting because the thickness of the disc 20 is quite significant for acquiring better acoustic effect. Therefore, only the conventional method of using screws to combine the frame 10 with the disc 20 can be employed, which takes time and is very inefficient. Also, if the frame 10 is a molded frame, the manufacturing speed and the assembling speed of this kind of frame is comparatively fast, yet, this kind of frame has poor acoustic effect and sometimes generates noise. If the frame 10 is made of plastic and manufactured by injection molding, it still is not able to be combined with the disc 20 by riveting.

For overcoming the abovementioned disadvantages, an injection molded loudspeaker frame with a metal disc of the present invention tends to mitigate and/or obviate the aforementioned problems.

SUMMARY OF THE INVENTION

The main objective of the invention is to provide an injection molded frame with a metal disc embedded therein for combining the advantages of metal material with the advantages of plastic material. The rapidly manufactured frame is made of plastic, and the disc is made of metal. Therefore, when the frame is molded, the disc is securely fixed within the frame. The frame of this kind is lightweight and is able to be combined with any necessary item by riveting, so that the assembling speed is greatly improved.

Another objective of the invention is to provide a plastic injection molded frame with a metal disc embedded therein for acquiring better acoustic effect even through the frame is made of plastic.

Other objects, advantages and novel features of the invention will become more apparent from the following detailed description when taken in conjunction with the accompanying drawings.

BRIEF DESCRIPTION OF THE DRAWINGS

The present invention will now be better understood with reference of the accompanying drawings wherein.

DETAILED DESCRIPTION OF THE PREFERRED EMBODIMENT

Figure 1:
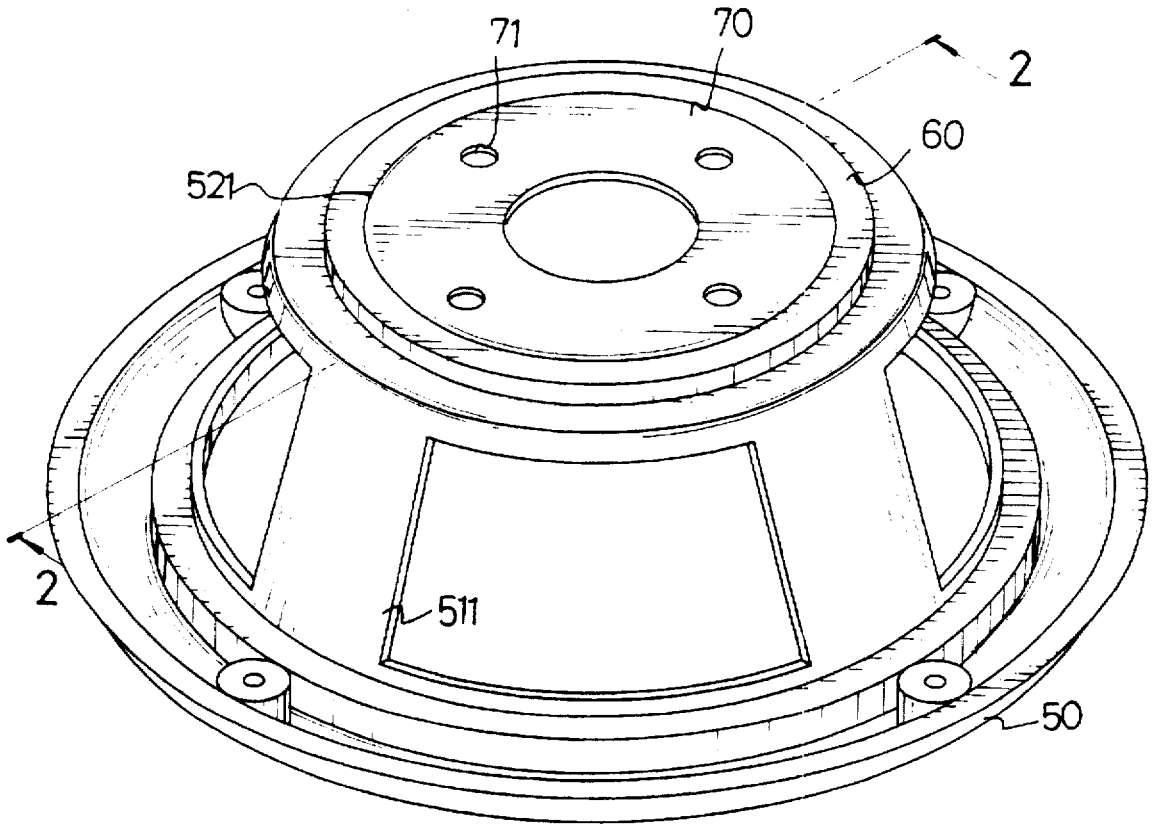
FIG. 1 is a perspective view of a plastic injection molded frame with a metal disc encased therein.
Figure 5:
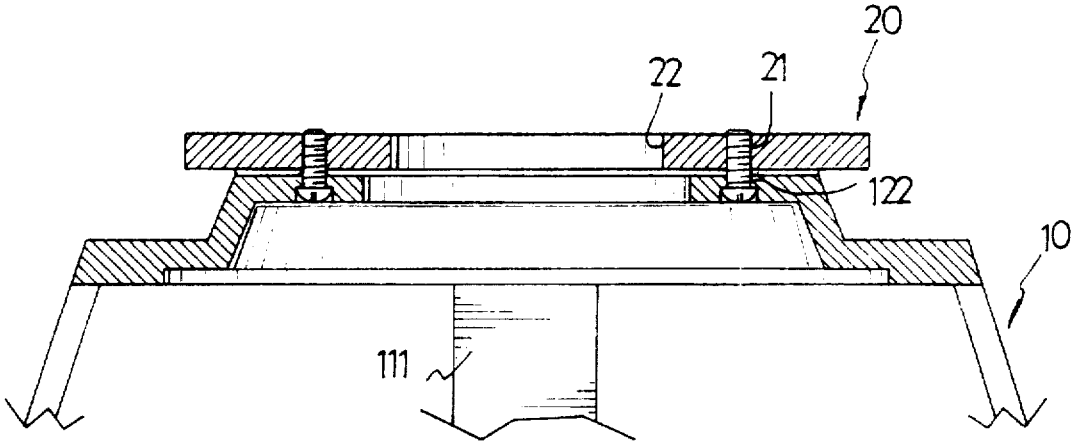
FIG. 5 PRIOR ART
FIG. 5 is a sectional view of FIG. 4 taken along line 5—5.

Referring to FIG. 1, one preferred embodiment of the invention is shown. A plastic injection molded frame is constructed to have a body 60, a flange 50, and a plurality of ribs 511 connected therebetween. The body 50 and the flange 60 are each configured to have a central hole (not numbered), and with these two central holes, the body 60 and the flange 50 are aligned concentrically. The frame, when injection molded, is provided with a peripheral shoulder 521 on an inner edge defining the central hole of the body 60 for providing support and fixing to a disc 70 which is securely received within the body 60 of the frame while the frame is injection molded.

Figure 2:
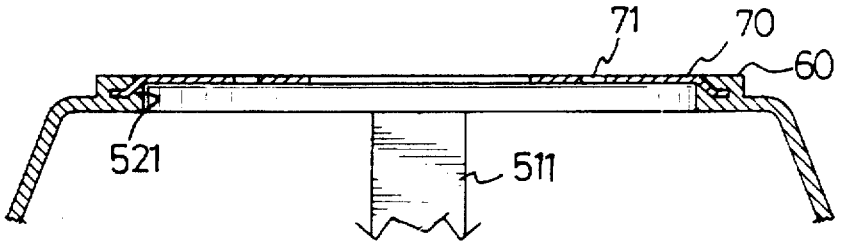
FIG. 2 is a sectional view of FIG. 1 taking along line 2—2.
Figure 3:
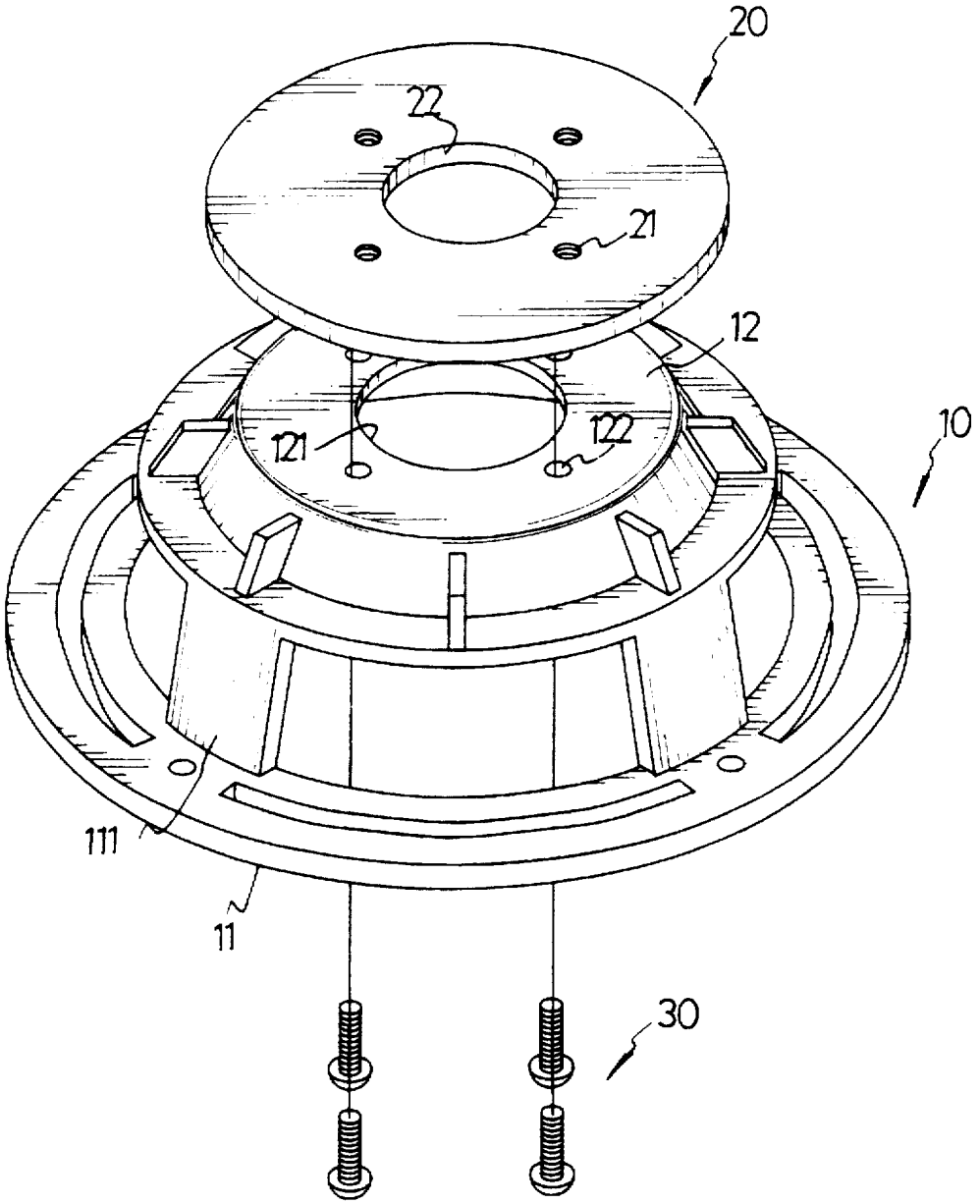
FIG. 3 PRIOR ART
FIG. 3 is an exploded view of a prior frame and a disc.
Figure 4:
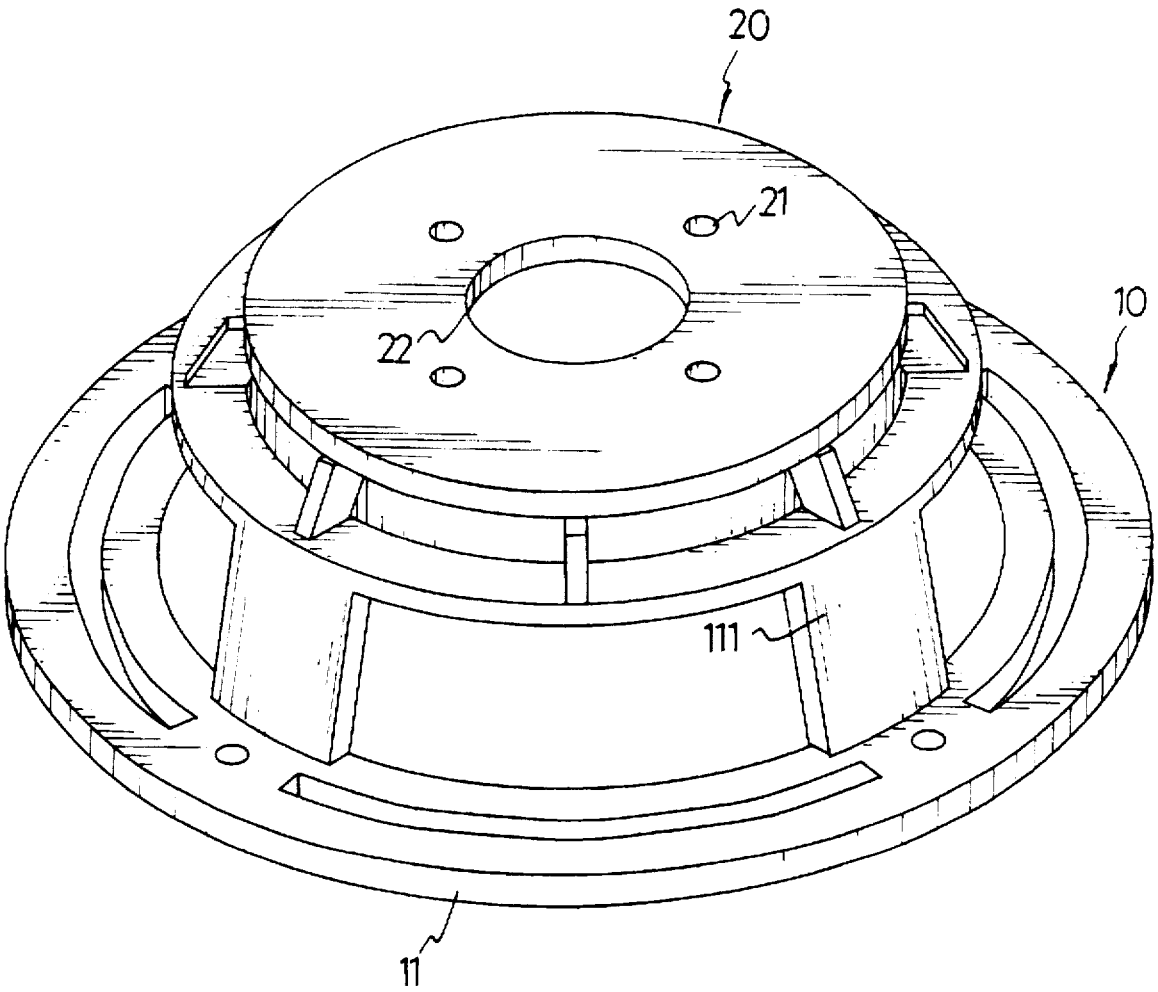
FIG. 4 PRIOR ART
FIG. 4 is a perspective view of the prior frame assembled with the disc.

The metal disc 70 embedded within the frame by the peripheral shoulder 521 is provided with a plurality of screwholes 71, so that the frame is able to be securely connected with a plate (not shown). The metal disc 70 embedded within the frame by the peripheral shoulder 521 is shown in FIG. 2. It is to be noted that after the metal disc 70 is embedded within the frame, a surface of the metal disc 70 and a surface of the body 60 are arranged flush, such that a plate (not shown) is able to be connected thereto.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A molded loudspeaker frame comprising a body having a central hole, a flange concentric with said body, a plurality of ribs connected therebetween, and a metal disc securely retained on said body, the improvement comprising:

a circumferential recess defined in an inner periphery defining said central hole of said body for forming an integral peripheral shoulder for providing support for and abutting said metal disc, the periphery of said metal disc being received within said recess for securely embedding said disc within said body of said frame.

* * * * *